US011621527B2

(12) United States Patent
Chen

(10) Patent No.: US 11,621,527 B2
(45) Date of Patent: Apr. 4, 2023

(54) ELECTRICAL CONNECTOR INCLUDING A METALLIC SHIELD HAVING A SUBSTANTIALLY VERTICAL PERIPHERAL WALL

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Ming-Ching Chen, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/408,354

(22) Filed: Aug. 20, 2021

(65) Prior Publication Data

US 2022/0059976 A1 Feb. 24, 2022

(30) Foreign Application Priority Data

Aug. 21, 2020 (CN) ..... 202010848740.6

(51) Int. Cl.

| | |
|---|---|
| ***H01R 13/6598*** | (2011.01) |
| ***H01R 13/6581*** | (2011.01) |
| ***H01R 43/24*** | (2006.01) |
| ***H01R 12/71*** | (2011.01) |
| *H01R 13/6585* | (2011.01) |

(Continued)

(52) U.S. Cl.

CPC ..... *H01R 13/6598* (2013.01); *H01R 12/71* (2013.01); *H01R 13/6581* (2013.01); *H01R 43/24* (2013.01); *H01R 12/712* (2013.01); *H01R 12/716* (2013.01); *H01R 12/73* (2013.01); *H01R 13/20* (2013.01); *H01R 13/405* (2013.01); *H01R 13/516* (2013.01); *H01R 13/6585* (2013.01)

(58) Field of Classification Search

CPC ..... H01R 13/6598; H01R 12/71; H01R 13/6581; H01R 43/24; H01R 12/712; H01R 13/6585; H01R 13/405; H01R 12/73; H01R 13/20; H01R 13/516; H01R 12/716

See application file for complete search history.

(56) References Cited

U.S. PATENT DOCUMENTS 9,450,340 B2 9/2016 Uratani et al.
10,498,055 B2 12/2019 Chen et al.

(Continued)

FOREIGN PATENT DOCUMENTS

CN 108565615 A 9/2018

*Primary Examiner* — Hae Moon Hyeon
*Assistant Examiner* — Justin M Kratt
(74) *Attorney, Agent, or Firm* — Ming Chieh Chang

(57) ABSTRACT

An electrical connector includes an insulative housing defining a vertical mating direction, a plurality of contacts secured to the insulative housing, and a metallic shield secured to the insulative housing and surrounding the plurality of contacts, wherein the metallic shield and the plurality of contacts are insert-molded with the insulative housing, and the metallic shield has a pair of substantially vertical side walls, a pair of substantially vertical end walls respectively connected between the pair of side walls, and a pair of bottom walls connected between the pair of side walls.

5 Claims, 9 Drawing Sheets

(51) Int. Cl.

| | |
|---|---|
| *H01R 12/73* | (2011.01) |
| *H01R 13/20* | (2006.01) |
| *H01R 13/516* | (2006.01) |
| *H01R 13/405* | (2006.01) |

(56) References Cited

U.S. PATENT DOCUMENTS

| | | | | |
|---|---|---|---|---|
| 10,734,741 | B2 | 8/2020 | Yukutake et al. | |
| 2018/0175561 | A1 | 6/2018 | Chen | |
| 2019/0097360 | A1* | 3/2019 | Chen | H01R 12/716 |
| 2019/0348780 | A1 | 11/2019 | Kitazawa et al. | |
| 2021/0057852 | A1 | 2/2021 | Teruki et al. | |
| 2021/0359469 | A1* | 11/2021 | Oosaka | H01R 13/648 |
| 2021/0359471 | A1* | 11/2021 | Oosaka | H01R 12/73 |

* cited by examiner

ELECTRICAL CONNECTOR INCLUDING A METALLIC SHIELD HAVING A SUBSTANTIALLY VERTICAL PERIPHERAL WALL

BACKGROUND OF THE INVENTION

1. Field of the Invention

The present invention relates to an electrical connector including an insulative housing defining a vertical mating direction, a plurality of contacts secured to the insulative housing, and a metallic shield secured to the insulative housing and surrounding the plurality of contacts, wherein the metallic shield and the plurality of contacts are so structured with respect to the insulative housing that a small outline and reliable electrical and mechanical connections of the electrical connector may be realized.

2. Description of Related Arts

China Patent No. 108565615 discloses a shielded board-to-board electrical connector assembly comprising a receptacle connector having a first metallic shield and a plug connector having a second metallic shield, wherein the second metallic shield has a pair of end wall but not any side walls. U.S. Pat. No. 10,734,741 discloses an electrical connector comprising a shield member having a pair of shield portions, four intermediate portions, a pair of coupling portions, four leg portions, four pressing portions, four attachment portions, and four auxiliary shield portions.

SUMMARY OF THE INVENTION

An electrical connector comprises: an insulative housing defining a vertical mating direction; a plurality of contacts secured to the insulative housing; and a metallic shield secured to the insulative housing and surrounding the plurality of contacts, wherein the metallic shield and the plurality of contacts are insert-molded with the insulative housing, and the metallic shield has a pair of substantially vertical side walls, a pair of substantially vertical end walls respectively connected between the pair of side walls, and a pair of bottom walls connected between the pair of side walls.

DETAILED DESCRIPTION OF THE PREFERRED EMBODIMENT

Figure 1:
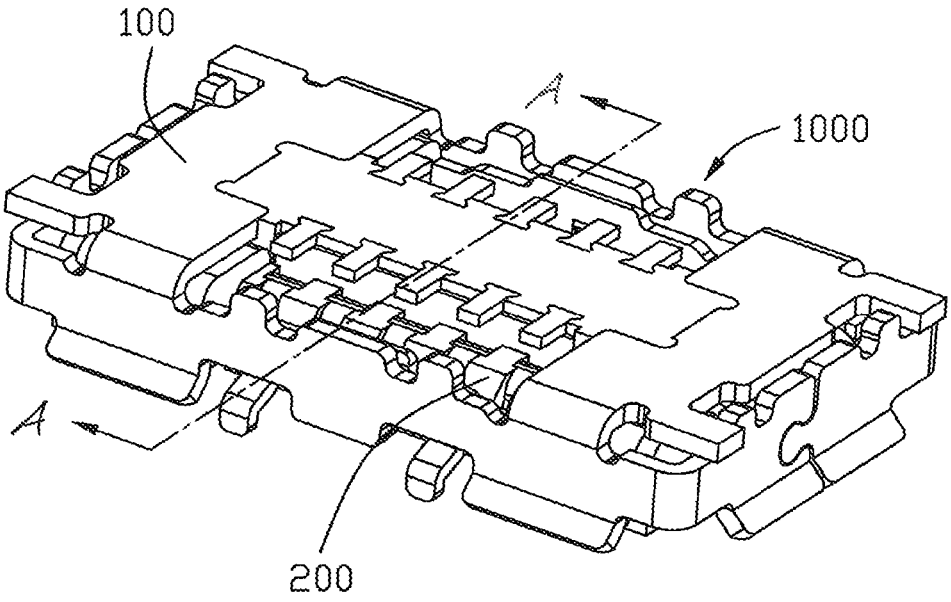
FIG. 1 is a perspective view of an electrical connector assembly in accordance with the present invention.
Figure 2:
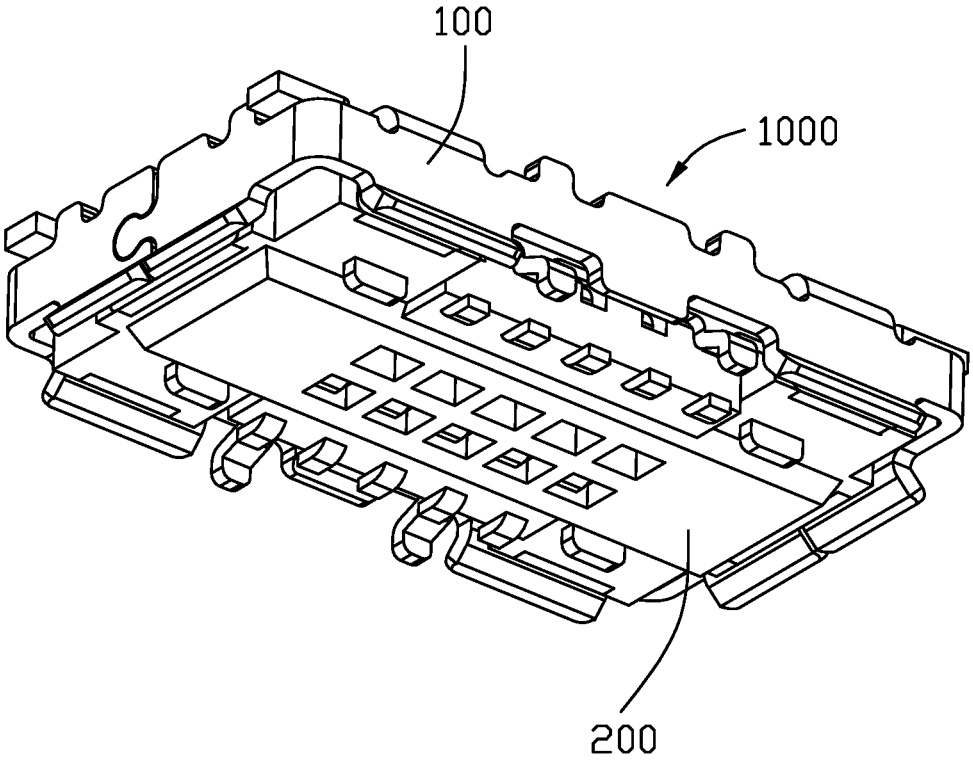
FIG. 2 is a view similar to FIG. 1 but from another perspective.
Figure 3:
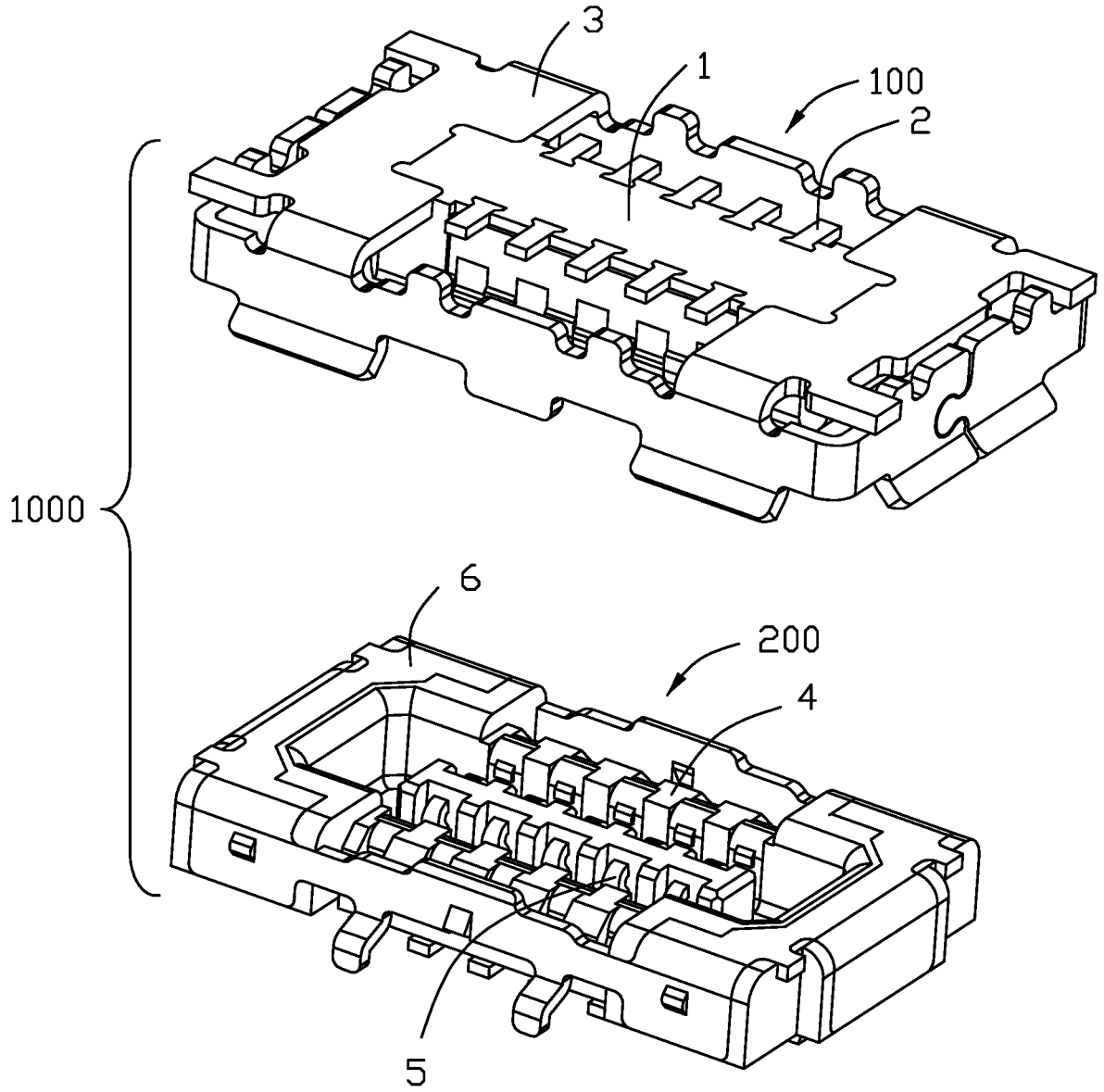
FIG. 3 is an exploded view of FIG. 1.
Figure 4:
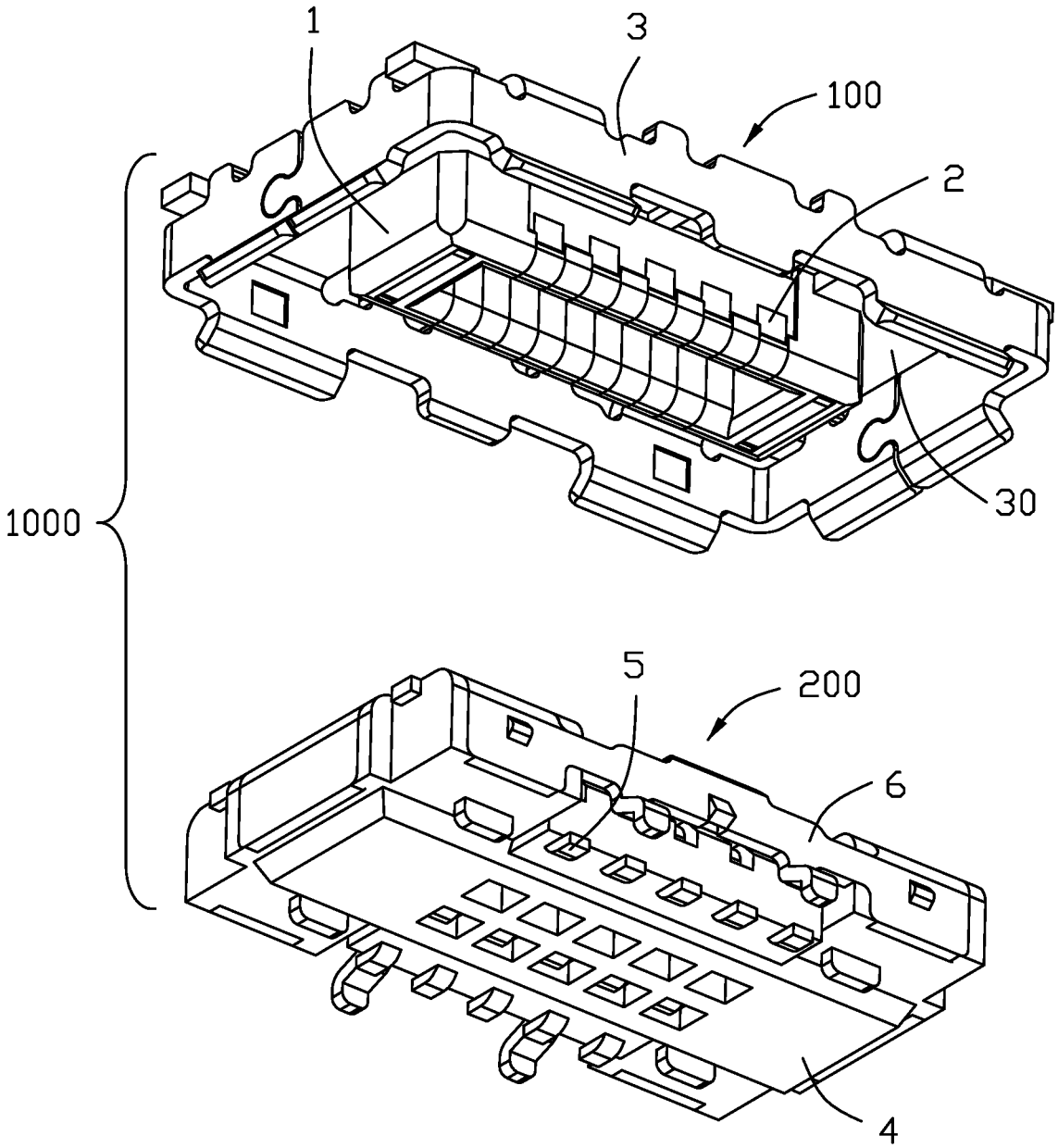
FIG. 4 is an exploded view of FIG. 2.

Referring to FIGS. 1-9, an electrical connector assembly 1000 includes a plug connector 100 and a mating receptacle connector 200. The plug connector 100 includes an elongate insulative housing 1 defining a vertical mating direction, a plurality of contacts 2 secured to the insulative housing 1 and arranged in two rows, and a metallic shield 3 secured to the insulative housing 1 and surrounding the plurality of contacts 2. Both the metallic shield 3 and the plurality of contacts 2 are insert-molded with the insulative housing 1. The receptacle connector 200 includes an elongate insulative housing 4, a plurality of contacts 5 secured to the insulative housing 4 and arranged in two rows, and a metallic shield 6 secured to the insulative housing 4 and surrounding the plurality of contacts 5. Both the metallic shield 3 and the plurality of contacts 5 are insert-molded with the insulative housing 4.

Referring specifically to FIGS. 1-6, the insulative housing 1 of the plug connector 100 has a base 11 and a tongue 12. The tongue 12 has a pair of side walls 121 along a lengthwise direction and a pair of end walls 122 along a widthwise direction together defining a receiving chamber 10. Each side wall 121 has an outer face 1211, an inner face 1212, and an intermediate upper face 1213. Each end wall 122 forms a hole 1221.

Figure 5:
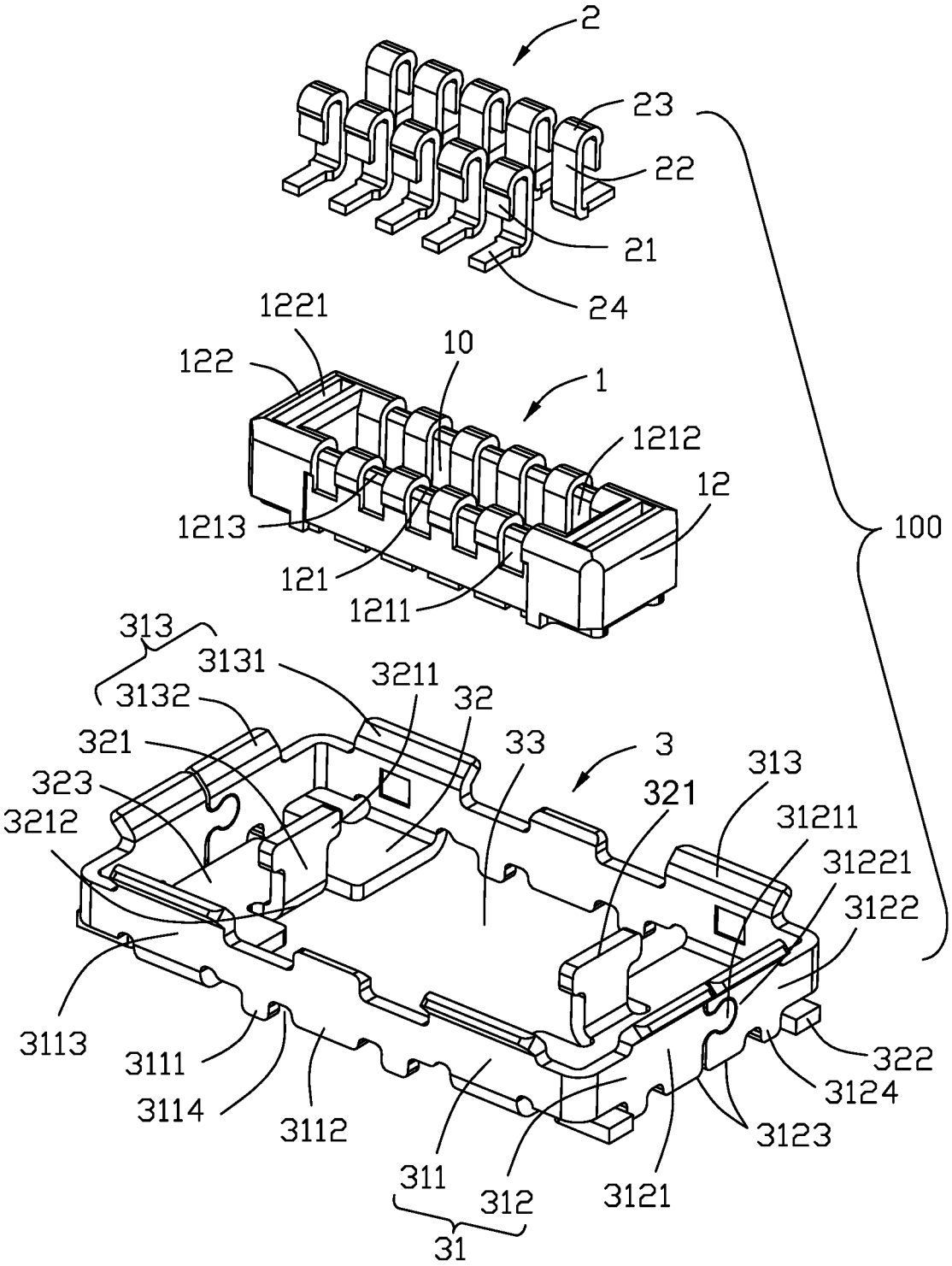
FIG. 5 is an exploded view of a plug connector of the electrical connector assembly.
Figure 6:
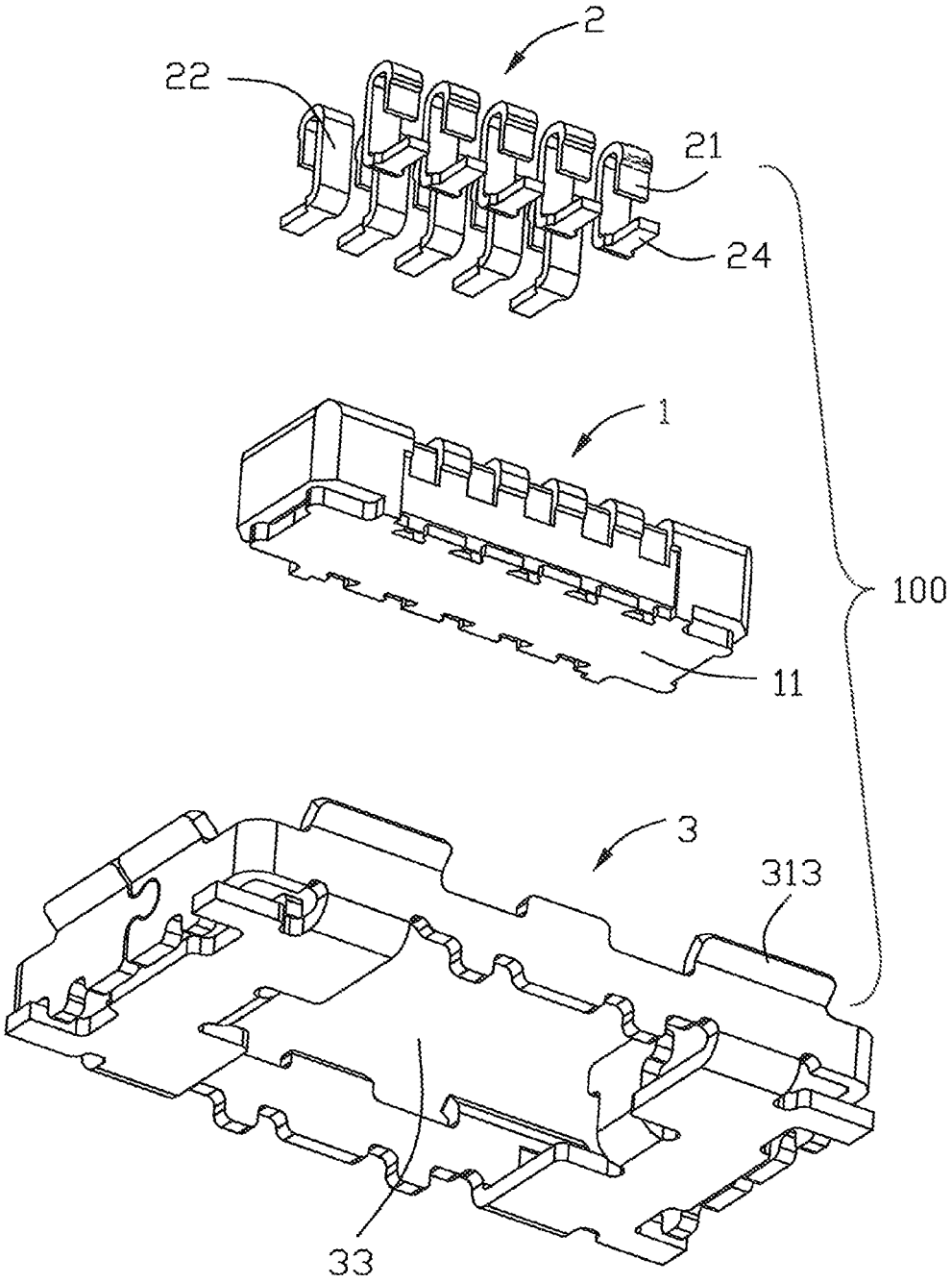
FIG. 6 is a view similar to FIG. 5 but from another perspective.
Figure 7:
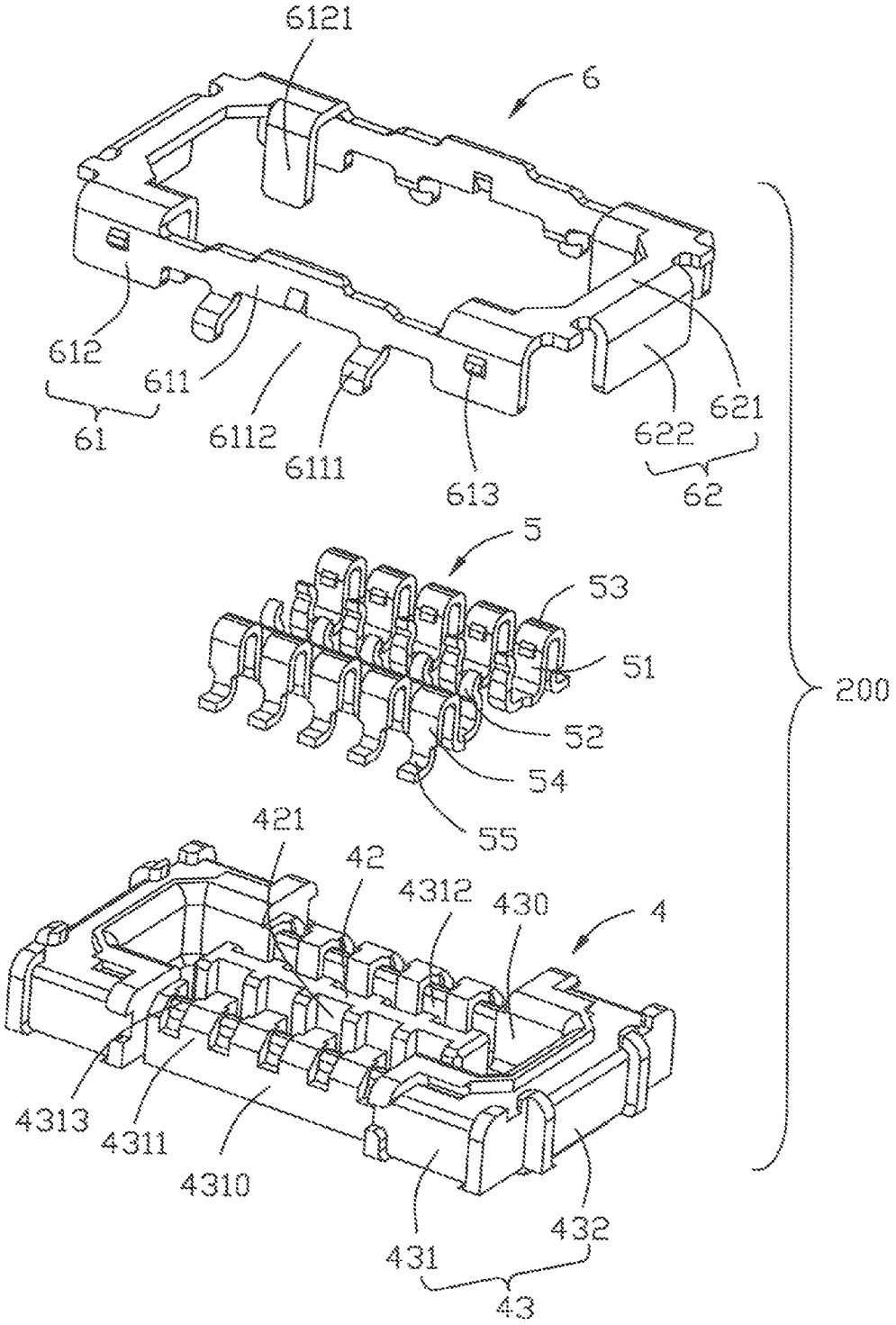
FIG. 7 is an exploded view of a receptacle connector of the electrical connector assembly.
Figure 8:
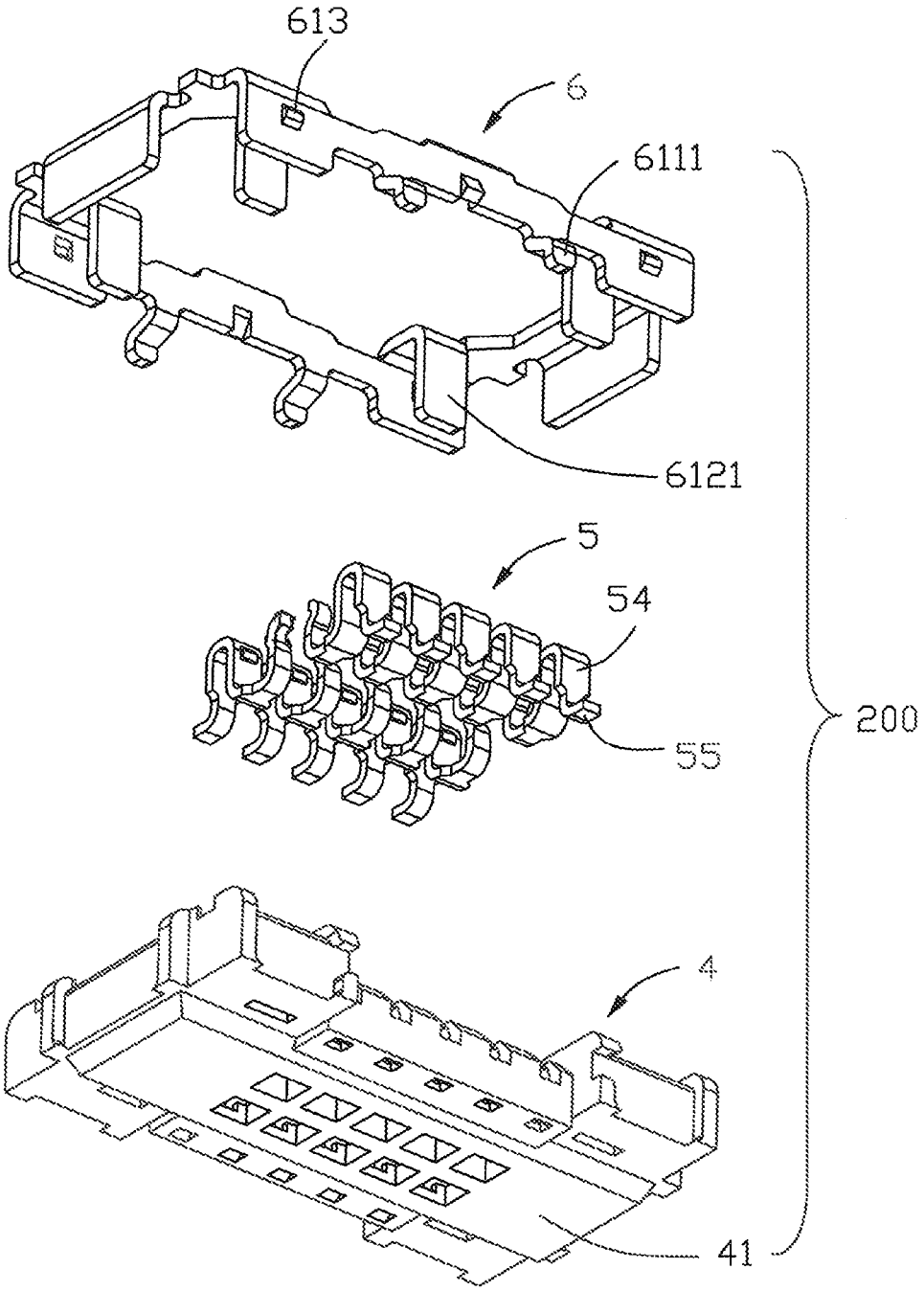
FIG. 8 is a view similar to FIG. 7 but from another perspective.

Referring specifically to FIGS. 5-6, each contact 2 has a first contact portion 21 at the outer face 1211, a second contact portion 22 at the inner face 1212, a connecting portion 23 at the upper face 1213, and a soldering portion 24 extending from the second contact portion 22.

The metallic shield 3 is of a unitary construction and includes a peripheral wall 31, which together with the tongue 12 encloses an annular groove 30, and a pair of bottom walls 32. The peripheral wall 31 has a pair of substantially vertical side walls 311 each extending along the lengthwise direction and a pair of substantially vertical end walls 312 respectively connected between the pair of side walls 311. The pair of bottom walls 32 are connected between respective end portions of the pair of side walls 311. The soldering portions 24 of the contacts 2 are located inside of the side walls 311. Each side wall 311 has a pair of soldering legs 3111 beside the soldering portions 24, a protrusion 3112 between the pair of soldering legs 3111, a pair of connecting portions 3113, and a pair of inspection windows 3114 between the protrusion 3112 and respective soldering legs 3111. The connecting portions 3113 of the pair of side walls 311 are connected to respective end portions of the pair of bottom walls 32. Each end wall 312 has a first end portion 3121 and a second end portion 3122 coupled to each other, such as by a dove-tailed structure 31211 and 31221, or spot welding. Each end wall 312 also has a pair of extensions 3123 and a pair of stoppers 3124. The peripheral wall 31 has a guiding portion 313, namely, the side walls 311 have guiding portions 3131 and the end walls 312 have guiding portions 3132.

Each bottom wall 32 has an anchor 321 retained in the hole 1221 of the insulative housing 1. The anchor 321 is substantially T-shaped and has a head 3211 and a root 3212. Each bottom wall 32 has an abutting edge 323 immediately beside the pair of extensions 3123 and a pair of limiters 322. The pair of limiters 322 cooperate with the pair of stoppers 3124 of an associated end wall 312 to prevent the first and second end portions 3121 and 3122 thereof from decoupling. The metallic shield 3 includes a bottom opening 33 defined between the pair of side walls 311 and the pair of bottom walls 32, and the soldering portions 24 of the contacts 2 are located within the bottom opening 33.

Figure 9:
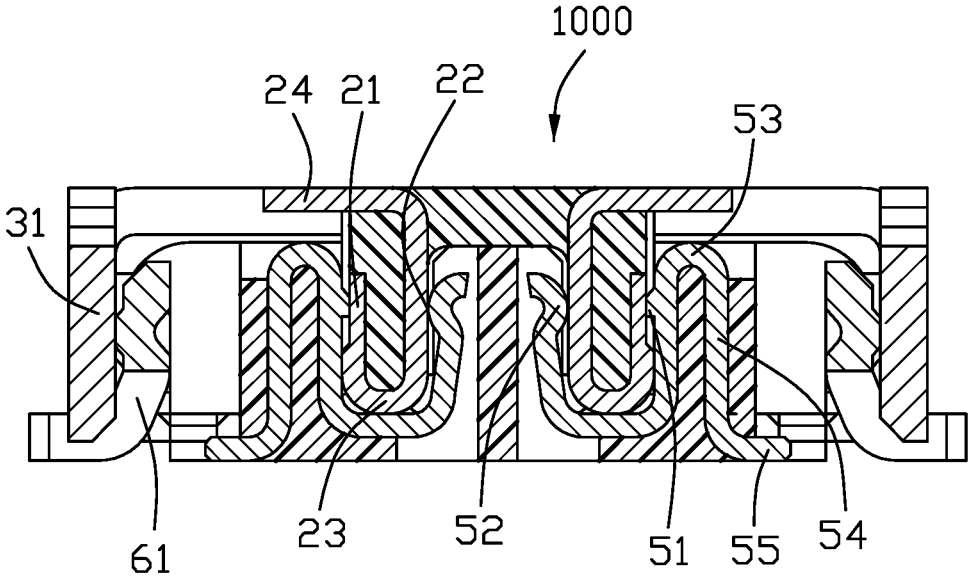
FIG. 9 is a cross-sectional view taken along line A-A in FIG. 1.

Referring specifically to FIGS. 1-4 and 7-9, the insulative housing 4 of the receptacle connector 200 has a base 41, a tongue 42, and a peripheral wall 43 together defining an annular groove 430. Opposite outer faces 421 of the tongue 42 receive the contacts 5. The peripheral wall 43 includes a pair of side walls 431 and a pair of end walls 432. Each side wall 431 has an outer face 4311, an inner face 4312, and an intermediate upper face 4313. Each contact 5 has a securing portion 54, a first contacting portion 51, a second contacting portion 52, a connecting portion 53, and a soldering portion 55. The contact 2 mates with the contact 5 in a generally known manner as shown in FIG. 9.

Each side wall 431 has a recessed portion 4310 and the soldering portions 55 are located under this recessed portion 4310. The metallic shield 6 has a pair of side walls 61 and a pair of end parts 62. Each side part 61 has a covering portion 611 and a pair of side portions 612. Each end part 62 has a top portion 621 and a guide portion 622. The covering portion 611 has a pair of soldering legs 6111 and an inspection window 6112 between the pair of soldering legs 6111. Each side wall 61 further has a pair of protrusions 613 and a pair of anchors 6121.

What is claimed is:

1. An electrical connector comprising:

an insulative housing defining a vertical mating direction;

a plurality of contacts secured to the insulative housing; and a metallic shield secured to the insulative housing and surrounding the plurality of contacts; wherein the metallic shield and the plurality of contacts are insert-molded with the insulative housing;

the metallic shield has a pair of substantially vertical side walls, a pair of substantially vertical end walls respectively connected between the pair of side walls, and a pair of bottom walls connected between the pair of side walls;

each of the pair of end walls has a first end portion and a second end portion coupled to each other; and each of the pair of bottom walls has a pair of limiters and an associated end wall has a pair of stoppers to prevent the first and second end portions thereof from decoupling.

2. The electrical connector as claimed in claim 1, wherein each of the pair of bottom walls has an anchor retained to the insulative housing.

3. The electrical connector as claimed in claim 1, wherein the metallic shield is of a unitary construction.

4. The electrical connector as claimed in claim 1, wherein the metallic shield includes a bottom opening defined between the pair of side walls and the pair of bottom walls, and the plurality of contacts include respective soldering portions located within the bottom opening.

5. The electrical connector as claimed in claim 1, wherein each of the side walls and the end walls has a guiding portion.

* * * * *